US006799759B1

(12) United States Patent
McNamara et al.

(10) Patent No.: US 6,799,759 B1
(45) Date of Patent: Oct. 5, 2004

(54) BOOKLET MAKER WITH CONTACT MEMBER

(75) Inventors: Joseph M. McNamara, Mississauga (CA); Yanmin Mao, Brampton (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/401,339

(22) Filed: Mar. 27, 2003

(51) Int. Cl.[7] ..... B65H 37/04

(52) U.S. Cl. ..... 270/58.08; 270/58.09; 270/58.11; 270/58.12; 270/37; 399/410; 493/444; 493/384

(58) Field of Search ..... 493/384, 405, 493/444; 270/58.08, 58.11, 58.12, 58.14, 58.16, 58.17, 32, 37; 399/410

(56) References Cited

U.S. PATENT DOCUMENTS 5,316,280 A 5/1994 Watkiss ..... 270/37
6,022,011 A * 2/2000 Hirose ..... 270/37
6,145,825 A * 11/2000 Kunihiro et al. ..... 270/58.09

FOREIGN PATENT DOCUMENTS

JP 2001019268 A * 1/2001 ..... B65H/31/32

* cited by examiner

*Primary Examiner*—Patrick Mackey
(74) *Attorney, Agent, or Firm*—R. Hutter

(57) ABSTRACT

In a booklet maker, as would be found in conjunction with a copier or printer, sheets to be folded and stapled into a booklet are accumulated in a slot. At the bottom of the slot, a selectably extendable contact member presses an accumulating set of sheets against a sidewall of the slot following the entry of each new sheet into the slot. The contact member decreases curling and fluffing of sheets within the slot, which can cause imprecisions in registering, stapling, or creasing of the sheets as they are formed into a booklet.

6 Claims, 2 Drawing Sheets

BOOKLET MAKER WITH CONTACT MEMBER

TECHNICAL FIELD

The present disclosure relates to a booklet maker, as would be used, for instance, in conjunction with a digital copier or printer.

BACKGROUND AND DESCRIPTION OF PRIOR ART

Booklet makers are well-known devices for forming folded booklets which are stapled along the crease thereof. It is becoming common to include booklet makers in conjunction with office-range copiers and printers (as used herein, a "copier" will be considered a type of "printer"). In basic form, a booklet maker includes a slot for accumulating signature sheets, as would be produced by a printer. The accumulated sheets, forming the pages of a booklet, are positioned within the stack so that a stapler mechanism and complementary anvil can staple the stack precisely along the intended crease line. In one embodiment, the creased and stapled sheet sets are then pushed, by a blade, completely through crease rolls, to form the final main fold in the finished booklet. The finished booklets are then accumulated in a tray downstream of the crease rolls. One example of a practical booklet maker design is shown in U.S. Pat. No. 5,316,280.

The present disclosure relates to an improved design of a booklet maker, which is particularly useful in conjunction with an office-range digital printer.

SUMMARY OF THE INVENTION

According to one aspect of the present invention, there is provided an apparatus for folding a set of sheets, comprising means defining a slot for accumulating sheets, the slot including a sidewall and a bottom. A selectably-operable contact member is disposed near the bottom of the slot, the contact member being operable to press at least one accumulated sheet against the sidewall of the slot. Means are provided for operating the contact member following entry of a sheet into the slot. A crease roll is disposed adjacent the slot. A blade is provided for directing the set of sheets toward the crease roll.

DETAILED DESCRIPTION OF THE INVENTION

Figure 1:
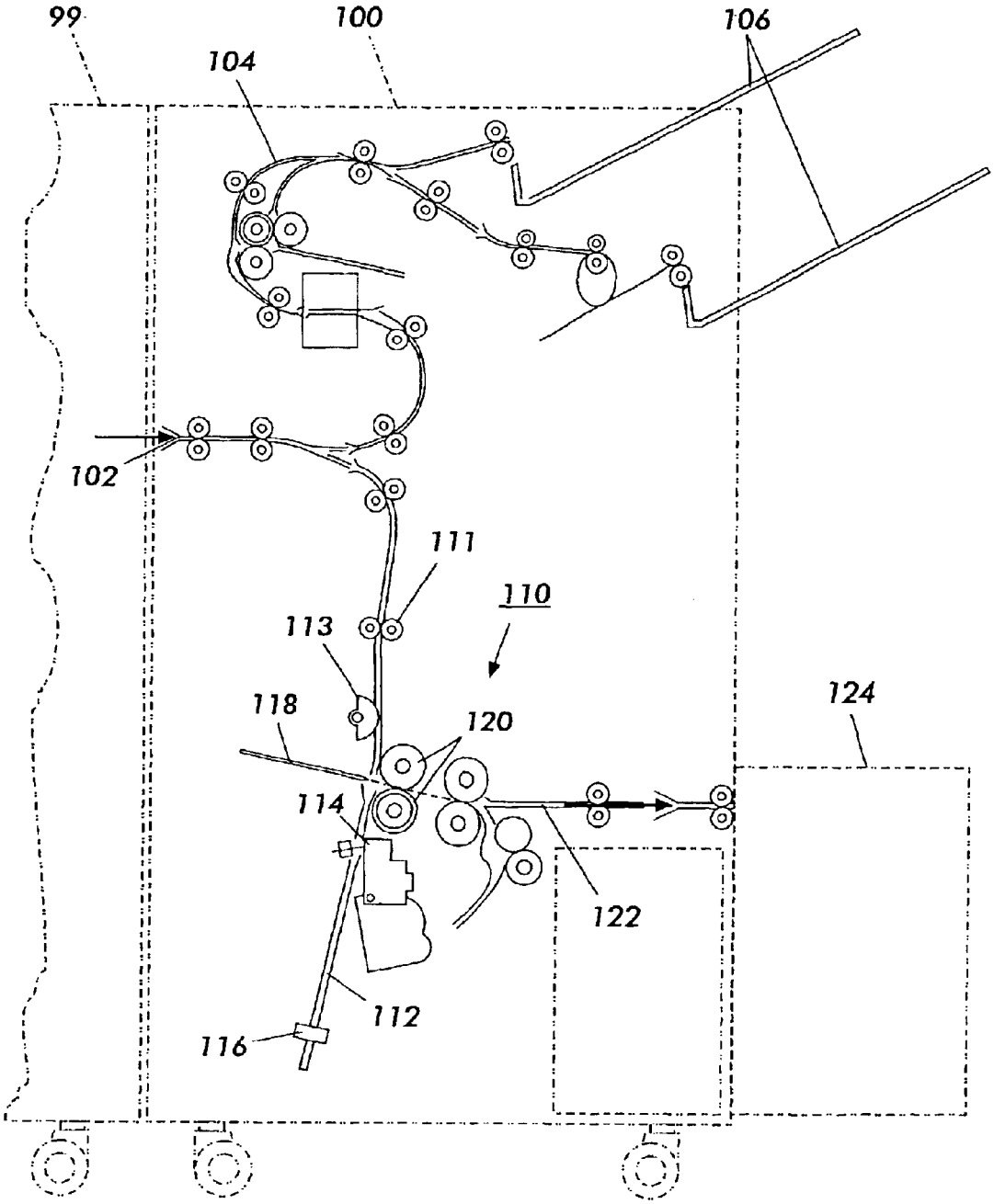
FIG. 1 is a simplified elevational view of a "finisher module," including a booklet maker, as would be used with an office-range digital printer.

FIG. 1 is a simplified elevational view of a "finisher module," generally indicated as 100, including a booklet maker, as would be used with an office-range digital printer. Printed signature sheets from the printer 99 are accepted in an entry port 102. Depending on the specific design of finisher module 100, there may be numerous paths such as 104 and numerous output trays 106 for print sheets, corresponding to different desired actions, such as stapling, hole-punching and C- or Z-folding. It is to be understood that the various rollers and other devices which contact and handle sheets within finisher module 100 are driven by various motors, solenoids and other electromechanical devices (not shown), under a control system, such as including a microprocessor (not shown), within the finisher module 100, printer 99, or elsewhere, in a manner generally familiar in the art. For present purposes what is of interest is the booklet maker generally indicated as 110.

Booklet maker 110 defines a "slot" which is here indicated as 112. Slot 112 accumulates signature sheets (sheets each having four page images thereon, for eventual folding into pages of the booklet) from the printer 99. Each sheet is held within slot 112 at a level where a stapler 114 can staple the sheets along a midline of the signatures, the midline corresponding to the eventual crease of the finished booklet. In order to hold sheets of a given size at the desired level relative to the stapler 114, there is provided at the bottom of slot 112 an elevator 116, which forms the "floor" of the slot 112 on which the edges of the accumulating sheets rest before they are stapled. The elevator 116 is placed at different locations along slot 112 depending on the size of the incoming sheets, so that the trailing edge of the sheets will initially be adjacent the sheet ordering roll assembly 111. Also, elevator 116 is, for a given sheet size, movable (by means not shown, but typically including a motor or solenoid) among three positions, a first position where the trailing edge of the sheets are adjacent the sheet ordering roll assembly 111, a second position where the midpoint of the sheets are adjacent the stapler 114, and a third position, as will be described below.

As printed signature sheets are output from printer 99, elevator 116 is positioned so that the trailing edge of the output sheets (which would be at the top of slot 112) are disposed at sheet ordering roll assembly 111. When all of the necessary sheets to form a desired booklet are accumulated in slot 112, elevator 116 is moved from its first position to a second position where the midpoint of the sheets are adjacent the stapler 114. Stapler 114 is activated to place one or more staples along the midpoint of the sheets, where the booklet will eventually be folded.

After the stapling, elevator 116 is moved from its second position to a third position, where the midpoint of the sheets are adjacent a blade 118 and a nip formed by crease rolls 120. The action of blade 118 and crease rolls 120 performs the final folding, and sharp creasing, of the sheets into the finished booklet. Blade 118 contacts the sheet set along the stapled midpoint thereof, and bends the sheet set toward the nip of crease rolls 120, which draw all the sheets in and form a sharp crease. The creased and stapled sheet sets then drawn, by the rotation of crease rolls 120, completely through the nip, to form the final main fold in the finished booklet. The finished booklets are then conducted along path 122 and collected in a tray 124.

Figure 2:
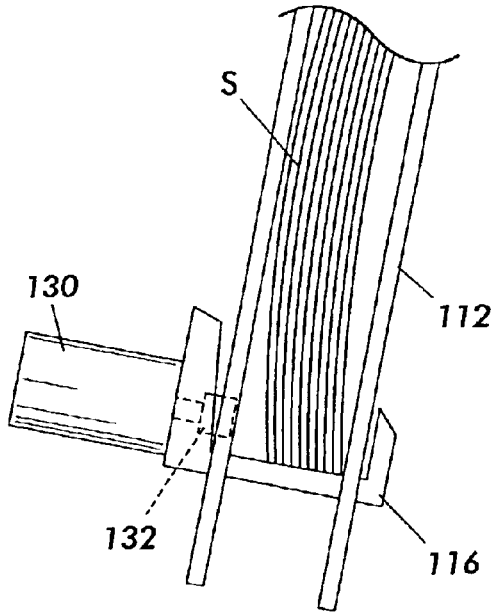
FIGS. 2 and 3 are detailed views showing the operation of a device in conjunction with a booklet maker as in FIG. 1.
Figure 3:
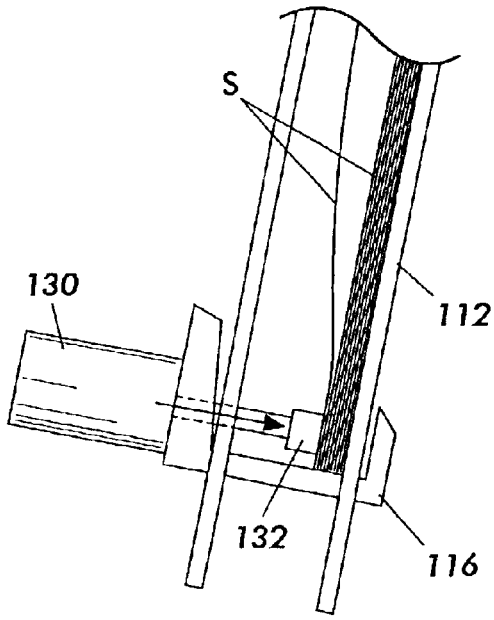

FIGS. 2 and 3 are detailed views showing the operation of a device in conjunction with a booklet maker as in FIG. 1. Of interest is the elevator 116, forming a backstop to retain the sheet sets at the bottom of slot 112. As shown, there is associated with backstop 116 a solenoid 130, having a plunger 132 with an end cap (or, more broadly, a "contact member") which is movable from a first, retracted position (shown in FIG. 2) to a second, extended position (shown in FIG. 3) which extends into slot 112 and presses a set of sheets S against one wall of the slot 112. In this embodiment, plunger 132 is extended to its second position when the solenoid 130 is energized, such as through a control system as described above. Also, although a solenoid with a plunger is illustrated, any equivalent hardware can be used, such as including a stepper motor, for instance.

As can be seen by comparing FIGS. 2 and 3, when the plunger 132 is extended into its second position, the sheets S which are in slot 112 at any time are pushed against a wall of slot 112. The configuration of sheets S in FIG. 2 shows why the use of plunger 132 is desirable: without the plunger 132, the accumulating sheets in slot 112 may be curved and/or "fluffed" (have appreciable cushions of air between adjacent sheets). The curving and fluffing can result in imprecisions in the placement of staples by stapler 114 as shown in FIG. 1, and/or in the folding of the booklet by blade 118 as shown in FIG. 1: the curving and fluffing will alter the location of the true midpoint of the sheets during stapling or folding. The curving and fluffing can also effectively close off the slot 112, preventing or resisting the following sheet(s) from entering the slot 112 causing jams or process mis-registration (poor alignment in the direction of sheet travel).

According to one embodiment, the solenoid 130 is activated to extend plunger 132 against a full or partial set of sheets in slot 112 following the placement of each new sheet in slot 120, with the plunger being withdrawn back into its FIG. 2 position in intervals to allow each new sheet to fully enter slot 112. However, the pressing of plunger 132 after the entry of each sheet helps to open up space within slot 112 for receiving the next sheet, which provides a practical advantage, as can be seen by comparing FIGS. 2 and 3.

As shown in the illustrated embodiment, plunger 132 defines a contact member which is of a small size, such as one-half inch in diameter or generally less than three square inches in effective area, where it contacts the sheet in slot 112. It may alternately be desirable, in some circumstances, to have a larger contact member, contacting the sheet over more surface area. A larger contact member may be useful in pushing air from between sheets in the slot 112; however, in some designs, due to static electricity in the sheets, a large contact member may cause the sheet to stick to the left wall, and thus cause the sheet to get out of order relative to other sheets which will enter slot 112 later.

A flapper drive roll, indicated as 113, also penetrates into the paper path slot 112 after each sheet is fed into slot 112, but before the solenoid 130 is energized to ensure that the sheet is driven all the way to the backstop 116. However, the action of flapper drive roll 113 also generates fluff and curl in the lower half of the slot 112, reinforcing the requirement of using solenoid 130 to remove/reduce the fluff and curl in the lower half of slot 112.

When the full sheet set is accumulated in slot 112, the extended plunger 132 can be used to pin the whole stack in position for stapling and moving of the stack on elevator 116 so that the midpoint of the stack is aligned with the blade 118. When the creasing from blade 118 begins, the plunger 132 is released so that the sheet stack can be drawn through the creasing rolls 120 as shown in FIG. 1.

What is claimed is:

1. An apparatus for folding a set of sheets, comprising:

means defining a slot for accumulating sheets, the slot including a sidewall and a bottom;

a selectably-operable contact member operable to press at least one accumulated sheet against the sidewall;

means for operating the contact member following entry of a sheet into the slot; the means for operating the contact member retracting the contact member during entry of a sheet into the slot;

a crease roll disposed adjacent the slot;

a blade for directing the set of sheets toward the crease roll;

a stapler positioned to staple a set of sheets within the slot;

an elevator movable within the slot, the elevator being movable to move a sheet within the slot;

the elevator and contact member being operable so that the contact member presses a sheet against the sidewall as the elevator moves a predetermined portion of the sheet in the slot between the stapler and the blade.

2. The apparatus of claim 1, further comprising a sheet order roll assembly disposed at a predetermined location along the slot.

3. The apparatus of claim 1, wherein the contact member defines less than three square inches of area to contact a sheet.

4. An apparatus for folding a set of sheets, comprising:

means defining a slot for accumulating sheets;

an elevator movable within the slot, the elevator being movable to move a sheet within the slot, the elevator having a sidewall associated therewith;

a contact member for pressing at least one accumulated sheet against the sidewall; the contact member being selectably actuable; means for operating the contact member following entry of a sheet into the slot; the means for operating the contact member retracting the contact member during entry of a sheet into the slot;

a blade useful for folding at least one sheet accumulated in the slot; and a stapler positioned to staple a set of sheets within the slot;

the contact member pressing at least one sheet against the sidewall as the elevator moves a predetermined portion of the sheet in the slot between the stapler and the blade.

5. The apparatus of claim 1, further comprising a sheet order roll assembly disposed at a predetermined location along the slot.

6. The apparatus of claim 1, wherein the contact member defines less than three square inches of area to contact a sheet.

* * * * *